US009702242B2

(12) United States Patent
Noui-Mehidi et al.

(10) Patent No.: US 9,702,242 B2
(45) Date of Patent: Jul. 11, 2017

(54) METHOD AND APPARATUS FOR IN-WELL WIRELESS CONTROL USING INFRASOUND SOURCES

(71) Applicant: Saudi Arabian Oil Company, Dhahran (SA)

(72) Inventors: Mohamed Nabil Noui-Mehidi, Dhahran (SA); Michael John Black, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 383 days.

(21) Appl. No.: 14/156,833

(22) Filed: Jan. 16, 2014

(65) Prior Publication Data

US 2014/0198617 A1 Jul. 17, 2014

Related U.S. Application Data

(60) Provisional application No. 61/753,335, filed on Jan. 16, 2013.

(51) Int. Cl.

| | |
|---|---|
| ***E21B 47/04*** | (2012.01) |
| ***E21B 34/06*** | (2006.01) |
| ***E21B 47/18*** | (2012.01) |

(52) U.S. Cl.

CPC ..... *E21B 47/04* (2013.01); *E21B 34/066* (2013.01); *E21B 47/18* (2013.01)

(58) Field of Classification Search

CPC ..... E21B 47/04; E21B 47/18; E21B 34/066
See application file for complete search history.

(56) References Cited

U.S. PATENT DOCUMENTS

| | | | |
|---|---|---|---|
| 3,507,341 | A | 4/1970 | Basgan |
| 3,922,622 | A | 11/1975 | Boyd et al. |
| 4,266,879 | A | 5/1981 | McFall |
| 4,624,220 | A | 11/1986 | Olsson |
| 4,866,680 | A | 9/1989 | Scherbatskoy |
| 5,531,270 | A | 7/1996 | Fletcher et al. |
| 5,587,707 | A | 12/1996 | Dickie et al. |

(Continued)

OTHER PUBLICATIONS

PCT Communication Relating to the Results of the Partial International Searching Authority; dated Nov. 17, 2014; International Application No. PCT/US2014/011817; International file Date: Jan. 16, 2014.

A.Kondis, "Acoustical Wave Propagation in Buried Water Filled Pipes", MIT Masters Thesis 2005.

C. Aristègui, M.J.S. Lowe and P. Cawley, "Guided Waves in Fluid-Filled Pipes Surrounded by Different Fluids", Ultrasonics 39 (2001) 367-375.

(Continued)

*Primary Examiner* — James Yang
(74) *Attorney, Agent, or Firm* — Bracewell LLP; Constance Gall Rhebergen

(57) ABSTRACT

A system and method for downhole data communication using an infrasound wave generator and receivers. The infrasound waves have a low frequency and a wavelength that is much larger than the transverse dimensions of the well. When the infrasound waves are directed down the well, the well will act as a wave guide for low frequency excitations. The receivers are operatively connected to inflow valves and other downhole equipment, and receive the infrasound waves. If the waves are of a predetermined frequency, the receivers command the valves to open or close, or otherwise control downhole equipment. The infrasound waves can also be used to probe well geometry and to identify fluid properties within the well.

20 Claims, 2 Drawing Sheets

(56) References Cited

U.S. PATENT DOCUMENTS

| | | | | |
|---|---|---|---|---|
| 5,706,896 | A * | 1/1998 | Tubel | E21B 34/066 166/313 |
| 5,995,449 | A | 11/1999 | Green et al. | |
| 6,414,905 | B1 | 7/2002 | Owens et al. | |
| 7,400,262 | B2 | 7/2008 | Chemali et al. | |
| 8,037,747 | B2 | 10/2011 | Difoggio | |
| 8,319,657 | B2 | 11/2012 | Godager | |
| 2003/0196816 | A1 | 10/2003 | Aronstam | |
| 2005/0168349 | A1 | 8/2005 | Huang et al. | |
| 2007/0030762 | A1 | 2/2007 | Huang et al. | |
| 2008/0173717 | A1 * | 7/2008 | Antebi | G01S 5/22 235/439 |
| 2010/0149919 | A1 | 6/2010 | Segal | |
| 2011/0096950 | A1 | 4/2011 | Rougas et al. | |
| 2011/0267922 | A1 | 11/2011 | Shampine et al. | |

OTHER PUBLICATIONS

K. Tezuka, C. Chen and X.M. Tang, "Modeling Low-Frequency Stoneley Wave Propagation in an Irregular Borehole" MIT Lab Report 1994.

M.R. Riazi, G.A. Mansoori, "Use of the Velocity of Sound in Predicting the PVT Relations", Fluid Phase Equilibria 90 (1993) 251-264.

P.T. Negraru and E.T. Herrin, "On Infrasound Waveguide and Dispersion", Seismological Research Letters 80 (2009) 565-571.

R.A. Waldron, "Some Problems in the Theory of Guided Microsonic Waves", IEEE Transactions on Microwave Theory and Techniques, MTT-17 (1969) 893-904.

* cited by examiner

METHOD AND APPARATUS FOR IN-WELL WIRELESS CONTROL USING INFRASOUND SOURCES

BACKGROUND OF THE INVENTION

1. Field of the Invention

The present technology relates to oil and gas wells. In particular, the present technology relates to control of downhole valves and equipment using infrasonic waves in oil and gas wells.

2. Description of the Related Art

The production of oil and gas wells typically requires the use of various valves and other downhole equipment. For example, an inflow control valve (ICV) assembly can be inserted into the well bore, and can include an inflow valve 23 that regulates the flow of fluid through the bore. The communication of commands from an operator at the surface to such valves and other downhole equipment is important to production control of the well.

One way to communicate with downhole valves and other equipment is through a physical connection, such as wires. Such wires can be inserted into the hole along with, for example, an ICV assembly, and can be connected to the inflow valve 23. When the ICV assembly is in place in the well, an operator on the surface can then send opening and closing commands to the inflow valve 23 to regulate production. One problem with the use of wires, however, is the difficulty of running them into the well without tangling or breaking the wires. This can be especially problematic in multilateral wells, where lateral bores can be diverging from the motherbore in different directions, and each lateral bore can have its own ICV assembly.

In an attempt to avoid the problems of running wires into the well, some operators have employed wireless communication systems to communicate with downhole valves and other equipment. Many of these wireless communication systems use time pulsed waves at common communication frequencies to communicate commands to the valves. One problem with such systems, however, is that such common communication frequency bands have a very limited range, and are ineffective at communicating over long distances downhole. This range problem can be exacerbated by the nature of the fluids in a wellbore, many of which have high salinity and can be dense.

SUMMARY OF THE INVENTION

One embodiment of the present technology provides a system for controlling equipment in a wellbore using infrasonic waves. The system includes an infrasound generator positioned near the opening of the wellbore, the infrasound generator including a resonator and an actuator for producing infrasound waves, the infrasound generator capable of directing the infrasound waves down the wellbore. The system further includes a receiver attached to downhole equipment in the wellbore, and capable of receiving the infrasound waves and, based on the frequency of the infrasound waves, communicating commands to the downhole equipment.

The equipment in the wellbore can be an inflow valve configured to regulate production flow. In certain embodiments, the wellbore can be a multilateral wellbore having a motherbore and a lateral bore, and the equipment can be a plurality of inflow valves located in the motherbore and the lateral bore and configured to regulate production flow. In such embodiments, separate receivers can communicate with each of the plurality of inflow valves, and each receiver can communicate commands to the inflow valves responsive to infrasound waves having a different frequency. The frequency of the infrasound waves can be between about 0.1 Hz and about 20 Hz, and optionally between about 0.1 Hz and about 10 Hz.

In one embodiment, machinery can be located above the infrasound generator, which infrasound generator has a resonator and an actuator. In such an embodiment, the actuator channels white noise from the machinery, and the resonator filters out substantially all noise other than the frequency required to control the downhole equipment.

The resonator and actuator of the infrasound generator can be configured in any appropriate way. For example, the resonator of the infrasound generator can be a resonator array which substantially spans the infrasound frequency spectrum, and each resonator in the array can be coupled with a low-power actuator. Furthermore, the infrasound generator can include a sound multiplexer valve with a single broadband actuator capable of addressing multiple resonators. In some embodiments, the receiver can be capable of generating infrasound waves, thereby enabling two-way communication between the infrasound generator and the receiver.

Also disclosed herein is a method of controlling equipment in a wellbore. The method includes the steps of generating infrasound waves, directing the infrasound waves into the wellbore, fine-tuning the frequency of the infrasound waves until the infrasound waves reach a predetermined frequency, receiving the infrasound waves by a receiver positioned downhole, and sending a control command from the receiver to the equipment when the infrasound waves received by the receiver reach the predetermined frequency. In some embodiments, the step of generating the infrasound waves can further include filtering white noise from equipment at the top of the wellbore to isolate the frequency required to control the equipment.

In certain embodiments, the equipment is an inflow valve configured to regulate production flow, and the method further includes the step of opening or closing the inflow valve responsive to the control command from the receiver. Optionally, the wellbore can be a multilateral wellbore having a motherbore and a lateral bore. The equipment can be a plurality of inflow valves located in the motherbore and the lateral bore, and configured to regulate production flow. Separate receivers can communicate with each of the plurality of inflow valves, with each receiver communicating commands to the inflow valves responsive to infrasound waves having a different frequency.

In alternate embodiments, the method can also include the step of generating infrasound waves with the receiver, thereby enabling two-way communication between the infrasound generator and the receiver. The frequency of the infrasound waves can be between about 0.1 Hz and about 20 Hz, and optionally between about 0.1 Hz and about 10 Hz.

Further disclosed herein is a method of measuring the depth of a wellbore. The method includes the steps of generating infrasound waves, directing the infrasound waves into the wellbore, observing the infrasound waves for resonance indicating that the waves have reached the bottom of the wellbore, and calculating the depth of the wellbore based on the number of wavelengths of infrasound waves that have entered the wellbore when the resonance is observed. In some embodiments, the method can further include inserting reflectors into the bottom of the wellbore to help reflect infrasound waves that reach the bottom of the wellbore.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE EXEMPLARY EMBODIMENTS

Figure 1:
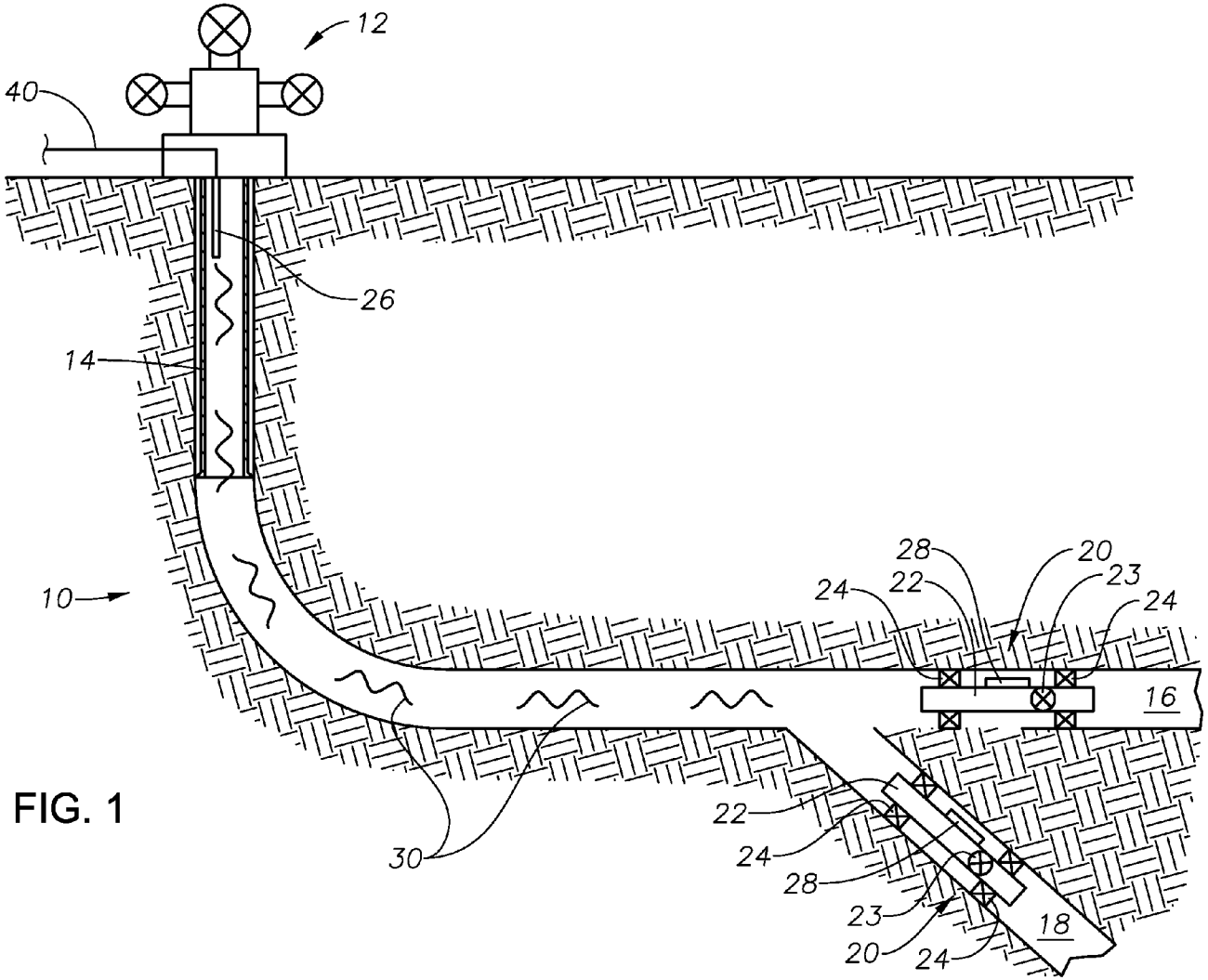
FIG. 1 is a side view of a multilateral well including an infrasonic wave system according to an embodiment of the present technology.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the embodiments are not intended to be limited to the specific terms used, and it is to be understood that each specific term includes equivalents that operate in a similar manner to accomplish a similar purpose.

FIG. 1 shows a side view of a well 10 having a wellhead 12 at the opening thereof, and tubing 14 extending partially therein. The well 10 is a multilateral well, having a plurality of bores, including a motherbore 16, and a lateral bore 18. In the embodiment shown, the tubing 14 is not cemented and does not extend to the bottom of the well. In fact, the tubing 14 does not extend to the first lateral bore 18. Included in at least one of the motherbore 16 and the lateral bore 18 is an inflow control valve (ICV) assembly 20 with an ICV body 22. The ICV assembly 20 is installed in the open hole, rather than a cased portion of the hole.

In the embodiment shown in FIG. 1, the ICV assembly 20 is a device that regulates the flow of fluid up through the well toward the wellhead 12. To accomplish this, the ICV assembly 20 has one or more open hole packers 24 that substantially seal the hole around the ICV assembly 20, thereby forcing fluid to pass through the ICV body 22 in order to move to the top of the well 10.

The flow of fluid through the ICV body 22 can be regulated by an inflow valve 23 within the ICV body 22. When the inflow valve 23 is open, fluid can freely pass through the ICV body 22. Conversely, when the inflow valve 23 is closed, fluid is restricted from passing through the ICV body 22. In the embodiment of FIG. 1, the position of the inflow valve 23 (open, closed, or partially open) can be controlled by an operator on the surface. By manipulating the position of the inflow valve 23, the operator can control how much fluid passes through the ICV body 22 towards the top of the well 10. Components of the ICA assembly 20, such as, for example, the inflow valve 23, can be powered by a battery (not shown). In addition, the inflow valves 23 can be indexed to specific frequency values.

Also shown in FIG. 1 is an infrasound generator 26 and a receiver 28. The infrasound generator 26 generates infrasound waves 30 of low frequency. Infrasound waves are sound waves having a frequency of from about 0.01 Hz to about 20 Hz. The frequency of infrasound waves is generally below the range of human hearing. In addition to having low frequency, these infrasound waves 30 can have a high amplitude. These infrasound waves are directed downhole, and travel through fluid within the well 10 from the infrasound generator 26 to the receiver 28. The configuration of the well causes the well to act like a fluid-filled pipe, which behaves acoustically as a waveguide, guiding the infrasound waves down the well. In some embodiments, the well can be between about 2,000 and about 10,000 feet deep, although well depths outside this range are possible also.

The receiver 28 receives the infrasound waves 30, and is operatively connected to the inflow valve 23. The receiver 28 can be configured to open or close the inflow valve 23 if the received infrasound waves 30 are of a predetermined frequency. In practice, there can be more than one receiver 28 attached to more than one ICV assembly 20 downhole, as shown in FIG. 1. In such an embodiment, the receiver 28 of each ICV assembly 20 can be set to open or close a corresponding inflow valve 23 at different frequencies. Thus, by varying the frequency of the infrasound waves 30, an operator can target and control individual inflow valves 23, thereby allowing frequency-based control of the valves.

Figure 2C:
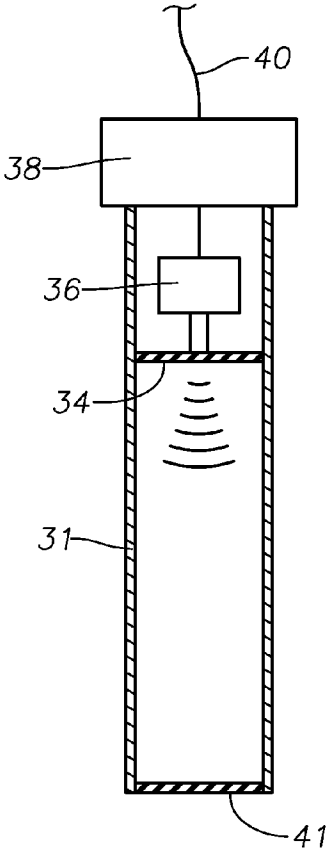
FIG. 2C is a side cross-sectional view of the infrasound generator of FIG. 2A, and including a secondary membrane.
Figure 2B:
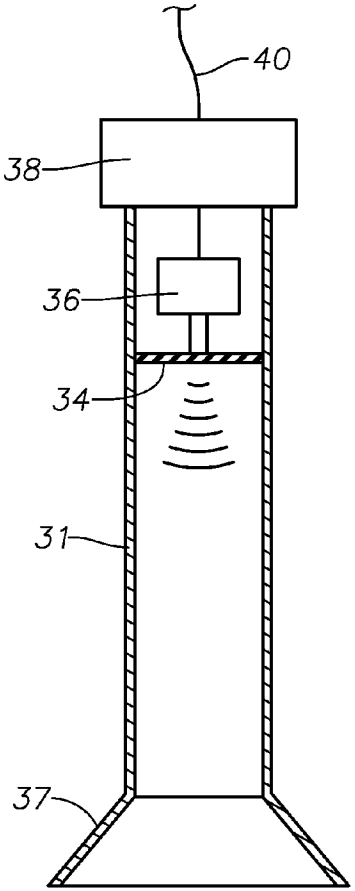
FIG. 2B is a side cross-sectional view of the infrasound generator of FIG. 2A, and including a flange.
Figure 2A:
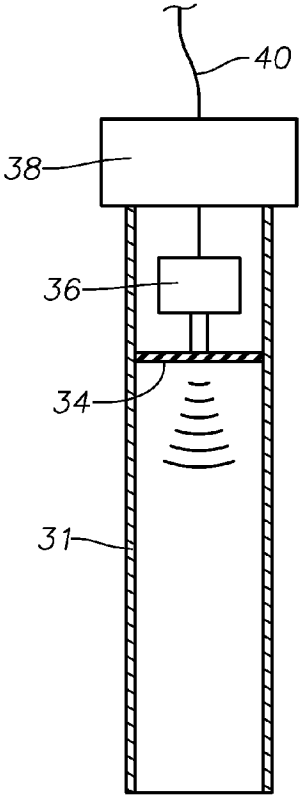
FIG. 2A is a side cross-sectional view of an infrasound generator according to the present technology.

Referring now to FIG. 2A, there is shown an infrasound generator 26 according to one embodiment of the present technology. The infrasound generator 26 can consist of an elongated tube 31 that acts as a resonator, as well as a diaphragm 34 and an actuator 36. The diaphragm 34 is typically in contact with, or immersed in, fluid contained within the elongated tube 31. The elongated tube 31 can have an approximate diameter equal to about ⅓ to ¼ the diameter of the wellbore in the vicinity of the elongated tube 31. The overall length of the elongated tube 31 can be about ¼ the total wavelength of the transmitted signal. For example, in the case where the resonant fluid is water, having an approximate speed of sound equal to 1500 m/s, and assuming that in this example the transmitted signal has a frequency of 20 Hz, the wavelength of the transmitted signal would be about 75 meters. Thus, the length of the elongated tube 31 would need to be about 18.75 meters. A more compact design can be achieved, however, by changing the fluid within the elongated tube 31. For example, if the elongated tube 31 contains flourosilicone oil FS-1265 (produced by Dow Corning®), which has a speed of sound of about 760 m/s, and assuming that the transmitted signal again has a frequency of 20 Hz, the wavelength of the transmitted signal would be about 38 meters. Thus, the length of the elongated tube 31 would need to be only about 9.5 meters. Where multiple frequencies are needed to control multiple valves in a well, different pipes of different lengths can be used, where each pipe is tuned to a particular transmission frequency. In addition, an impedance matching flange 37 (shown in FIG. 2B) can be attached at or near the end of the elongated tube 31 to help direct the waves from the elongated tube 31 into the wellbore.

As shown in FIGS. 2A-2C, the diaphragm 34 and actuator 36 can be controlled by an electronic mechanism 38, such as an electronic driving circuit. The electronic mechanism 38 can consist of, for example, a low frequency sinusoidal oscillator or a low frequency pulse generator, and can be connected by wires 40 or other means to a control room (not shown). The electronic mechanism 38 sends electrical signals either in the form of voltage or current pulses to the actuator 36. The output of the actuator 36 is then linked to the diaphragm 34, which could be made of any appropriate material, such as, for example, a thin sheet of metal, a plastic such as polytetraflouroethylene (PTFE), or other suitable material. The diaphragm 34 communicates with a liquid medium on the side opposite the actuator 36, The liquid medium could be well fluid or another liquid. if a fluid that is not the well fluid is used, such fluid may be separated from the well fluid by a secondary membrane 41 (shown in FIG. 2C) at or near the end of the elongated tube 31. It is contemplated that the actuator 36 can be an infrared laser. Alternately, the actuator can be an electromechanical actuator, such as a solenoid, a piezoelectric actuator, or a magnetostrictive actuator.

In some embodiments, the actuator can function by acting as a pilot valve to channel white noise from machinery, such as pumps or other machinery. In such embodiments, the electronic mechanism 38 and the actuator 36 can be replaced by a pilot valve which opens and closes to communicate the white noise from the surrounding fluid. By switching the valve on and off, the portion of the white noise that is resonant with the elongated tube 31 will be modulated. The white noise signals can be filtered according to known methods. For example, the white noise signal can be filtered with a low pass filter which can be implemented physically through a second resonant cavity, or through digital signal processing. Alternatively, the signal can be filtered using a lock-in amplifier style of measurement where the notch filter of the lock-in amplifier is matched to the transmission frequency of the infrasound. In this way, the resonance characteristics of the elongated tube 31 can filter out substantially all noise other than the required frequency to control a valve downstream.

As discussed above, the infrasound generator 26 generates infrasound waves 30 of low frequency. In some embodiments, the infrasound generator 26 generates infrasound waves 30 of sufficient bandwidth to index substantially the entire full infrasound frequency spectrum of about 0.1 to about 20 Hz. In other embodiments, the infrasound generator 26 can generate waves 30 of a narrower bandwidth, such as from about 0.1 to about 10 Hz. This can either be achieved by using a resonator of low Q value (where the Q value is the relative bandwidth of the resonator cavity) with a high-power actuator, or by implementing a highly tuned resonator array which spans the frequency spectrum, and wherein each resonator is coupled with a low-power actuator. Alternately, a sound multiplexer valve with a single broadband actuator could be used to address multiple resonators in turn.

In certain embodiments, the actuator 36 can he used as a receiver. This may be desirable where, for example, the receivers 28 generate infrasound waves, as discussed below. In such a case, incoming waves can enter the elongate tube 30 through the impedance matching flange 37 and contact the actuator 36 either directly or through the diaphragm 34. Because of the length of the elongated tube 30 and the properties of the fluid therein, the elongated tube 30 and the fluid therein act as an analog filter for only the infrasound produced. Vibrations cause the actuator 36 to move up and down and this signal can be amplified by the electronic mechanism 38 which can be powered in any suitable way, such as through wires 40 or by at least one battery. In addition, the actuator 36 could be replaced with a low frequency microphone.

The receiver 28 could consist of any appropriate receiver device, and can be removably installed in the wellbore on a permanent basis. For example, the receiver 28 could be an infrasound microphone device, or a high Q value resonant cavity. Such a resonant cavity can be similar in construction to an organ pipe, is set for a different frequency, and acts as a band pass filter for the particular frequency to be received. In use, each receiver is immersed in well fluid. in some embodiments, the receiver 28 can be configured to itself generate infrasound waves, similar to the infrasound generator 26, thereby enabling two-way communication between the infrasound generator 26 and the receiver 28. It is not necessary that the receivers 28 have full broadband capability, although such a feature is within the scope of the present technology. In addition, digital data can be communicated between the infrasound generator 26 and the receiver 28 by time domain pulse code modulation of the infrasound waves 30. Such time domain pulse code modulation can occur nominally at frequencies about 10% of that of the infrasound waves 30.

As discussed above, each receiver 28 can be in communication with, and set to open or close, a corresponding inflow valve 23 at different frequencies. For example, the receiver 28 attached to the ICV assembly 20 in the motherbore 16 can be configured to open or close its corresponding inflow valve 23 when it receives infrasound waves 30 having frequency A. Similarly, the receiver 28 attached to the ICV assembly 20 in the lateral bore 18 can be configured to open or close its corresponding inflow valve 23 when it receives infrasound waves 30 having frequency B. Thus, an operator can target the inflow valve 23 in the motherbore 16 or the lateral bore 18 by adjusting the frequency of the infrasound waves 30 to frequency A or B, respectively. Similarly, receivers 28 could be attached to other inflow valves 23 in other lateral bores (not shown), or even to other pieces of equipment, with each receiver 28 being set to respond to a different frequency. Accordingly, an operator can control multiple valves or other equipment by sending infrasound waves of differing frequency down the well 10.

The ability to control valves and other equipment using infrasound waves is beneficial in multilateral wells because it eliminates the need for a physical connection, or wires, between the top of the well and the valves or other equipment to be controlled. Such a physical connection can be difficult to maintain in multilateral wells because the well bores diverge, thereby requiring wires to be run into the bores individually.

In addition, control of valves using infrasound equipment has advantages over other known technologies, such as med pulse technology, and radio telemetry. Mud pulse technology relies on the generation of pulses, which cover a broad range of frequencies. With mud pulse technology, a significant amount of energy is lost in transmission because of frequency spread and dispersion of the high frequencies. This means that mud pulses can only reliably control valves over short distances. The technology described here, on the other hand, involves generation of a single low frequency that can travel long distances through a well. This means that the infrasound technology described herein is more effective at controlling valves at long range compared to mud pulse technology. Similarly, radio frequency (RF) telemetry has a very short range. Moreover, the fluids in the wellbore often have high salinity, which adds to the conductivity of the water and makes it more opaque to RF transmission. Infrasound is not so limited, and is a better candidate for long range transmission through open hole wells.

In addition, control of valves and other equipment according to the present technology provides advantages over other known acoustic telemetry systems, because known telemetry systems primarily rely on the time domain pulsing of waves. One problem with time domain pulsing is that the waves experience pulse broadening as they travel downhole through the fluid medium, and are thus range limited. In contrast, the infrasound waves of the present technology rely on the frequency of the waves to communicate with downhole valves and equipment, and not the pulsing of waves. Accordingly, the problem of pulse broadening is avoided, and the range is greatly extended. In addition, the range can be further extended in wells where optical fiber based distributed sensing is taking place. In such wells, the infrasonic waves 30 can be detected by a distributed acoustic sensing (DAS) system, which can serve to push the waves further into the well. A DAS system is a fiber optical sensing system that can be used to detect acoustic signals at any point along the fiber through Rayleigh scattering of a laser pulse sent down the fiber.

The system of the present technology can also be used to determine well geometry by scanning the frequency of the infrasound waves 30. For example, when an infrasound wave 30 reaches the bottom of the well 10, it will reflect off the bottom of the well 10, and begin moving back toward the top. As it does so, it will interact with the waves 30 traveling toward the bottom, and create resonance. Thus, an operator can send an infrasound wave 30 into the hole, and can determine when the wave 30 has reached the bottom of the hole by observing the resonance of the wave 30. If the operator knows the number of wavelengths that have entered the well 10 at the time resonance is observed, the operator can calculate the distance to the bottom of the well 10.

For example, assuming a water filled well with a speed of sound of 1500 m/s, the wavelength of the infrasound waves will range from about 15 km at 0.1 Hz down to about 75 m at 20 Hz. Thus, if an operator introduces an infrasound wave with a frequency of 20 Hz into a well, and observes resonance after three (3) wavelengths have entered the well, then the hole is about 225 meters deep.

This can be useful particularly in the case of multilateral wells, because the operator can calculate the depths of the different lateral bores by observing the resonance in the infrasound waves 30 as they reach the bottom of each of the lateral bores. This practice can be enhanced by adding reflectors at the end of the bores, to better reflect the infrasound waves 30 when they reach the ends of the bores. In the case of multilateral bores in particular, when the receivers 28 are positioned in the lateral bores they can be placed at known positions within the bores so that it is known which lateral contains each receiver. When the infrasound waves 30 pass through the receivers, and also when they are reflected back up through the receivers, this information can be relayed to the operator to indicate which lateral is being measured. In this way, the depths of different laterals can be distinguished one from another.

Furthermore, in wells where the well geometry is known, the present technology can be used to determine changes in the composition of the fluid within the well. For example, as well fluid becomes denser, the speed of sound through the fluid slows. This change in the speed of sound will generally lead to a downward shift in the frequency of the infrasound waves 30. Thus, by monitoring this shift in the infrasound waves 30, an operator can estimate the density of the fluid in the well.

Although the technology herein has been described with reference to particular embodiments, it is to be understood that these embodiments are merely illustrative of the principles and applications of the present technology. It is therefore to be understood that numerous modifications can be made to the illustrative embodiments and that other arrangements can be devised without departing from the spirit and scope of the present technology as defined by the appended claims.

What is claimed is:

1. A system for controlling equipment in a wellbore using infrasonic waves, the system comprising:

an infrasound generator positioned at the top of the wellbore, the infrasound generator including a resonator and an actuator for producing infrasound waves, the infrasound generator for directing the infrasound waves down the wellbore, wherein the wellbore functions acoustically as a waveguide; and a receiver attached to downhole equipment in the wellbore for receiving the infrasound waves and, based on the frequency of the infrasound waves, communicating commands to the downhole equipment, wherein the equipment in the wellbore comprises an inflow valve configured to regulate production flow; and machinery above the infrasound generator, wherein the infrasound generator has a resonator and an actuator, wherein the actuator channels white noise from the machinery and the resonator filters out noise other than the frequency required to control the downhole equipment.

2. The system of claim 1, wherein the wellbore is a multilateral wellbore having a motherbore and a lateral bore, and the equipment is a plurality of inflow valves located in the motherbore and the lateral bore and configured to regulate production flow.

3. The system of claim 2, wherein separate receivers communicate with each of the plurality of inflow valves, and each receiver communicates commands to the inflow valves responsive to infrasound waves having a different frequency.

4. The system of claim 1, wherein the frequency of the infrasound waves is between 0.1 Hz and 20 Hz.

5. The system of claim 4, wherein the frequency of the infrasound waves is between 0.1 Hz and 10 Hz.

6. The system of claim 1, wherein the resonator of the infrasound generator is a resonator array which substantially spans the infrasound frequency spectrum, and wherein each resonator in the array is coupled with a low-power actuator.

7. The system of claim 1, wherein the infrasound generator includes a sound multiplexer valve with a single broadband actuator for addressing multiple resonators.

8. The system of claim 1, wherein the receiver is for generating infrasound waves, thereby enabling two-way communication between the infrasound generator and the receiver.

9. A method of controlling equipment in a wellbore, the method comprising the steps of:

generating infrasound waves by machinery above an infrasound generator, wherein the infrasound generator has a resonator and an actuator, wherein the actuator channels white noise from the machinery and the resonator filters out noise other than the frequency required to control the equipment;

directing the infrasound waves into the wellbore;

fine-tuning the frequency of the infrasound waves until the infrasound waves reach a predetermined frequency;

receiving the infrasound waves by a receiver positioned downhole; and sending a control command from the receiver to the equipment when the infrasound waves received by the receiver reach the predetermined frequency, wherein the equipment is an inflow valve configured to regulate production flow, and wherein the wellbore functions acoustically as a waveguide.

10. The method of claim 9, wherein the step of generating the infrasound waves includes filtering white noise to isolate the frequency required to control the equipment.

11. The method of claim 9, further comprising the step of opening or closing the inflow valve responsive to the control command from the receiver.

12. The method of claim 9, wherein the wellbore is a multilateral wellbore having a motherbore and a lateral bore, and the equipment is a plurality of inflow valves located in the motherbore and the lateral bore and configured to regulate production flow, and wherein separate receivers communicate with each of the plurality of inflow valves, and each receiver communicates commands to the inflow valves responsive to infrasound waves having a different frequency.

13. The method of claim 9, further comprising the step of generating infrasound waves with the receiver, thereby enabling two-way communication between the infrasound generator and the receiver.

14. The method of claim 9, wherein the frequency of the infrasound waves is between 0.1 Hz and 20 Hz.

15. The method of claim 14, wherein the frequency of the infrasound waves is between 0.1 Hz and 10 Hz.

16. The system of claim 1, further comprising:

an elongated tube containing fluid within and functioning as a resonator.

17. The system of claim 1, wherein the actuator is controlled by an electronic mechanism.

18. The system of claim 1, wherein the actuator is a solenoid, a piezoelectric actuator, or magnetostrictive actuator.

19. The system of claim 1, wherein the receiver is configured to generate infrasound waves to enable two-way communication between the infrasound generator and the receiver.

20. The system of claim 1, wherein the actuator is a pilot valve that opens and closes to modulate the white noise.

* * * * *